United States Patent [19]

Noding et al.

[11] Patent Number: 4,895,635

[45] Date of Patent: Jan. 23, 1990

[54] CAUSTIC-CHLORINE ELECTROCHEMICAL CELL MONITORING APPARATUS AND METHOD

[75] Inventors: Stephen A. Noding, Brusly; John P. McGraw, Denham Springs, both of La.

[73] Assignee: The Dow Chemical Company, Midland, Mich.

[21] Appl. No.: 142,610

[22] Filed: Jan. 11, 1988

Related U.S. Application Data

[63] Continuation-in-part of Ser. No. 964,404, Dec. 23, 1986, abandoned.

[51] Int. Cl.[4] ..... G01N 27/26

[52] U.S. Cl. ..... 204/435; 204/278; 204/279

[58] Field of Search ..... 204/435, 1 T, 279, 278

[56] References Cited

U.S. PATENT DOCUMENTS

| | | | |
|---|---|---|---|
| 3,077,446 | 2/1963 | Van den Berg | 204/195 |
| 3,291,714 | 1/1962 | Hall et al. | 204/256 |
| 3,871,985 | 3/1975 | Crippen et al. | 204/231 |
| 4,163,698 | 8/1979 | Kuo et al. | 204/1 T |

OTHER PUBLICATIONS

Kirk Othmer Encyclopedia of Chemical Technology, Third Edition, vol. 1, John Wiley and Sons, Inc., New York, N.Y., pp. 806–825.

Kirk Othmer Encyclopedia of Chemical Technology, Third Edition, vol. 3, John Wiley and Sons, Inc., New York, N.Y., 1978, pp. 508 and 509.

Brochure on Standard 1199–31 Calomel Reference Electrode, Leeds & Northrup, North Wales, Pa., (date unknown).

*Primary Examiner*—John F. Niebling

*Assistant Examiner*—Steven P. Marquis

*Attorney, Agent, or Firm*—James M. Pelton; Richard G. Waterman; Dan R. Howard

[57] ABSTRACT

A novel electrochemical cell monitoring apparatus for a caustic-chlorine electrolyzer, which includes a voltmeter, a standard calomel reference electrode, a flexible conduit for cell bath, preferably of multilayer construction, and a conduit support body placed between electrode walls to prevent crimping of the conduit when the walls of the electrolyzer are pressed together or dislocation during operation, and the method of monitoring a selected electrochemical cell which includes connecting an electrode of the selected cell and the standard reference electrode to the voltmeter, providing cell bath from the electrode of the selected cell through the conduit to the liquid junction of the standard reference electrode, operating the electrolyzer and reading the voltage on the voltmeter to compare with a predetermined standard voltage.

13 Claims, 3 Drawing Sheets

CAUSTIC-CHLORINE ELECTROCHEMICAL CELL MONITORING APPARATUS AND METHOD

CROSS-REFERENCE TO RELATED APPLICATION

This application is a continuation-in-part of copending Application Ser. No. 964,404, filed Dec. 23, 1986, now abandoned.

BACKGROUND OF THE INVENTION

This invention relates to an apparatus and a method for monitoring electrochemical cells. Specifically, the present invention deals with a combination of equipment to provide continuous, reliable and efficient monitoring of a selected electrochemical cell from a caustic-chlorine electrochemical multicell electrolyzer, either single or multicell. While multicell electrolyzers are well known and widely used in the caustic-chlorine production industry, see for example Kirk-Othmer, *Encyclopedia of Chemical Technology, Third Edition,* Vol. 1, John Wiley & Sons, Inc., N.Y., 1978, pp. 806–825, it is always desirable to provide a means and method to check the operation of the electrolyzer. Usually, this is done by checking the overall voltage on the electrolyzer and the caustic and chlorine make. While it is impractical to have every electrochemical cell of a multicell electrolyzer monitored, it is feasible to spot check a pre-selected electrochemical cell using a standard calomel reference electrode to measure the anode or cathode overvoltage, for example with a Luggin capillary probe, as is conventionally known. However, this involves connecting the selected electrochemical cell to a voltmeter and the voltmeter to a reference electrode which is in contact with the cell bath of the multicell electrolyzer. Such connections are required prior to beginning operations in a multicell electrolyzer, are used to monitor only one cell, and cannnot be changed during operation of the multicell electrolyzer. Unfortunately, such operation has suffered from leakage at various connections, attack on monitoring equipment from the cell bath, breakage of the glass Luggin capillary tubes, and pinching of the sample line from the cathode compartment to the reference electrode. Further, the probes themselves are relatively costly and difficult to reach for installation.

Another overvoltage measurement system is described in U.S. Pat. No. 4,163,698 to Kuo et al which teaches connecting an insulated platinized platinum or $RuO_2.TiO_2$ coated Ti wire tip from 0.2 to 1.0 millimeters away from the gas producing electrode in the gas stream produced and connected at the other end to a voltmeter and to the electrode itself, and then reading the overvoltage directly on the voltmeter. However, the reference electrode wire tip is exposed to a corrosive environment and quickly loses the sensitivity of its original state.

Hall et al., U.S. Pat. No. 3,291,714, teaches an electrode for an electrolytic cell which includes an iron support coated with an iron alloy of molybdenum or tungsten to overcome corrosion problems and in which the cell has a conventional glass Luggin capillary which penetrates a rectangular polyethylene washer, which is used to space apart the electrodes and diaphragm membranes. The Luggin capillary extends into the cell and is spaced slightly apart from the center of the cathode and connects to the reference electrode by a salt bridge. U.S. Pat. No. 3,077,446 to Van den Berg teaches a reference electrode for pH meters which includes a tubular vessel with a capillary opening at one end for flow of liquid, a reference electrode in the tubular vessel and an electrolyte liquid which in addition to the water and potassium chloride has a nonionizing soluble organic compound, such as a glycol or glycerol, to depress the freezing point of the electrolyte and in which the capillary tube is a flexible elongate conduit having a flow restricting rigid glass stopcock. Crippen et al., U.S. Pat. No. 3,871,985, teaches a tip block for the conventional Luggin capillary tube which is of plastic material such as polypropylene or Teflon, and has an L-shaped channel which carries and protects the Luggin tube tip from damage. None of the prior art references teach an unbreakable capillary tube which can be securely placed and retained its position adjacent the electrode selected for monitoring, or which are capable in practical operation of being placed at more than one position in a cell. According to the present apparatus, and the method for using it, a safe, reliable, functional and convenient monitor system for a selected electrochemical cell of a multicell electrolyzer having a common electrolyte is provided.

SUMMARY OF THE INVENTION

The present invention provides a continuous monitor reference electrode assembly for a caustic-chlorine electrolyzer having one or more electrochemical cells, each cell having electrode chamber walls, and including a selected electrochemical cell or a site thereon to be monitored, which assembly comprises (a) a voltmeter, (b) a standard calomel reference electrode connected to said voltmeter and in contact with the cell bath of a selected electrochemical cell which is to be monitored by said reference electrode and which cell is also connected to said voltmeter through a cell electrode;

(c) a conduit support body having an aperture therein, said body being located and seated between said walls adjacent said selected electrochemical cell at a predetermined location thereon, and (d) a continuous hollow flexible conduit having one end passing through said aperture of said conduit support body and adjacent said body and open to an electrode of said selected electrochemical cell, but spaced apart therefrom and the other end associated with said reference electrode and providing fluid contact for said cell bath with said reference electrode; whereby location of said body provides sufficient separation and support between the cell to be monitored and an adjacent cell of said electrolyzer to prevent dislocation and pinching of said conduit when said walls are pressed together during operation so that said cell bath from said selected electrochemical cell flows to said reference electrode and performance of said selected electrochemical cell can be determined from said voltmeter.

A further aspect of the invention involves a method for monitoring the performance of a selected electrochemical cell, or a site thereon, of a caustic-chlorine electrolyzer having one or more electrochemical cells, each cell having electrode chamber walls, which method comprises:

(a) connecting a voltmeter to a standard calomel reference electrode and to an electrode of said selected electrochemical cell, inserting said reference electrode into one end of a hollow, flexible conduit having its other end adjacent and passing through an aperture in a conduit support body and open to an electrode of said selected electrochemical cell, but spaced apart therefrom, and open to the flow of cell bath which passes through said selected electrochemical cell, said conduit being supported at a predetermined location between said walls of said electrolyzer and adjacent said selected electrochemical cell, being seated between said walls and preventing said conduit from being pinched or dislocated during the pressing together of said walls of said electrolyzer during set up operations prior to start up and during operation;

(b) operating said electrolyzer after connecting the apparatus of step (a); and (c) during operation of said electrolyzer, reading the voltage measured by said voltmeter.

DESCRIPTION OF THE DRAWINGS

The Figures of the drawings attached hereto and made a part hereof which are not to scale, include like numerals referring to like parts and involve.

DETAILED DESCRIPTION OF THE PREFERRED EMBODIMENTS OF THE INVENTION

Figure 1:
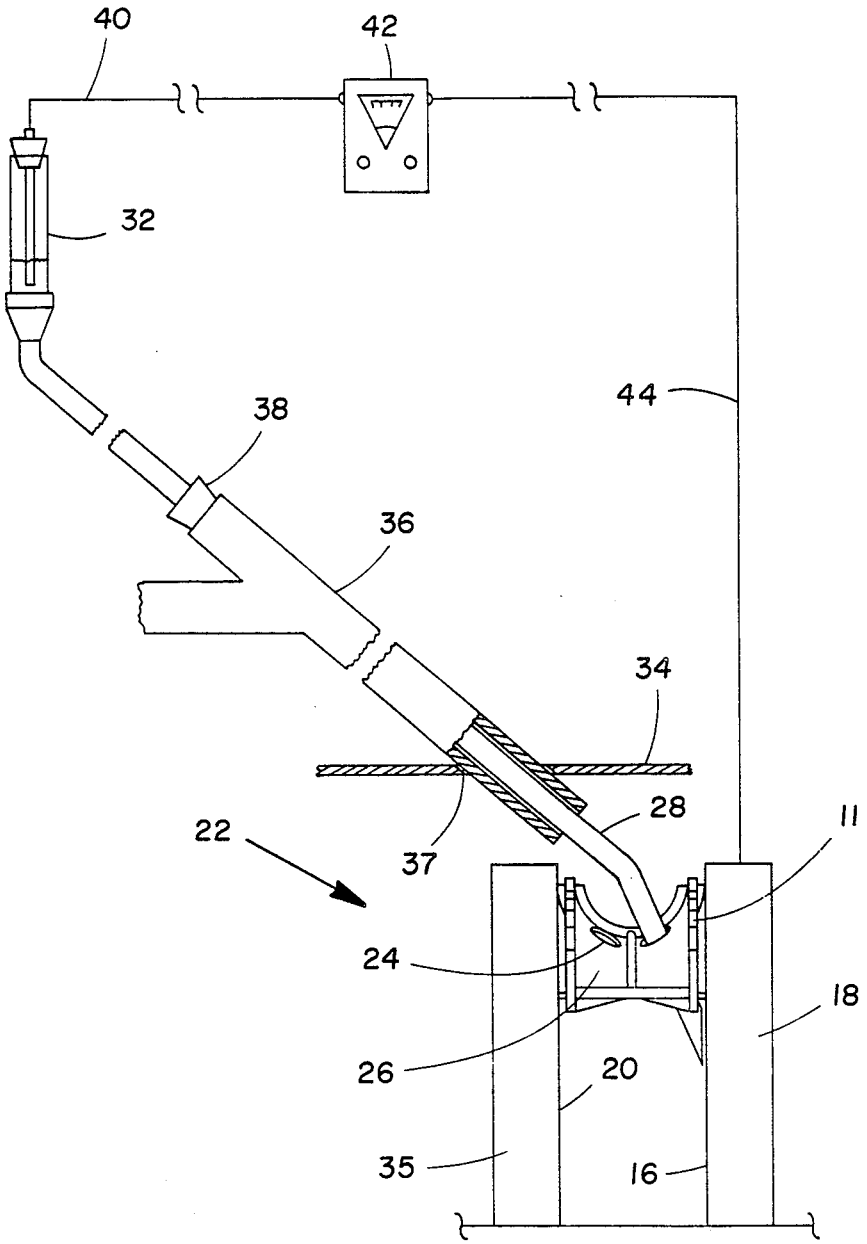
FIG. 1 illustratively, pictorially, and in partial cutaway view represents the continuous monitor reference electrode assembly including location of the conduit support body between a selected cell and an adjacent cell and connection with the standard calomel reference electrode, voltmeter, cell bath conduit, and selected electrochemical cell forming a complete electrical circuit.
Figure 2:
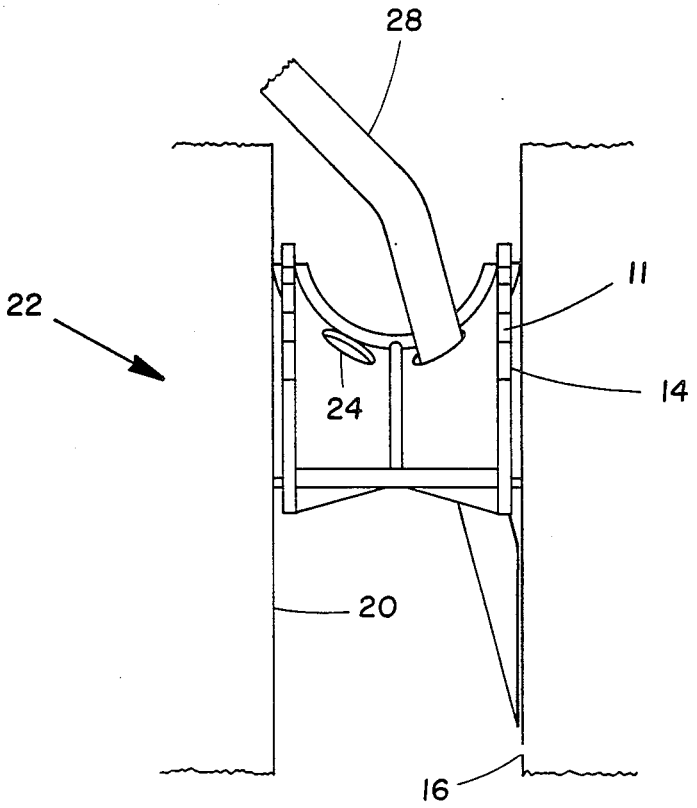
FIG. 2 pictorially depicts a partial side view of a multicell electrolyzer expanded prior to pressing the cells together for operation and showing located between the cells depicted a conduit support body adjacent the selected cell and one end of the conduit with the cell bath conduit passing through the support body.
Figure 4:
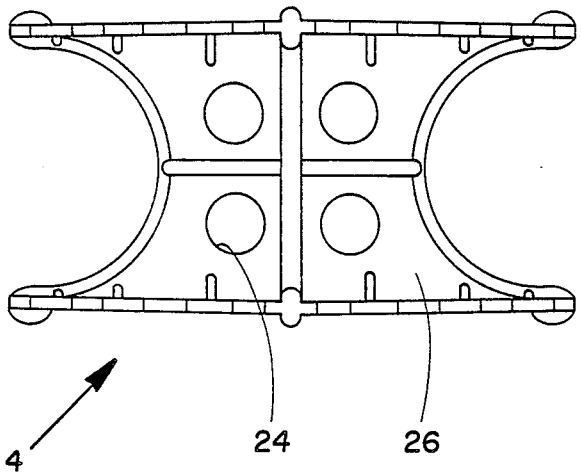
FIG. 4 is a top view of a preferred embodiment of the conduit support body of FIG. 3.
Figure 3:
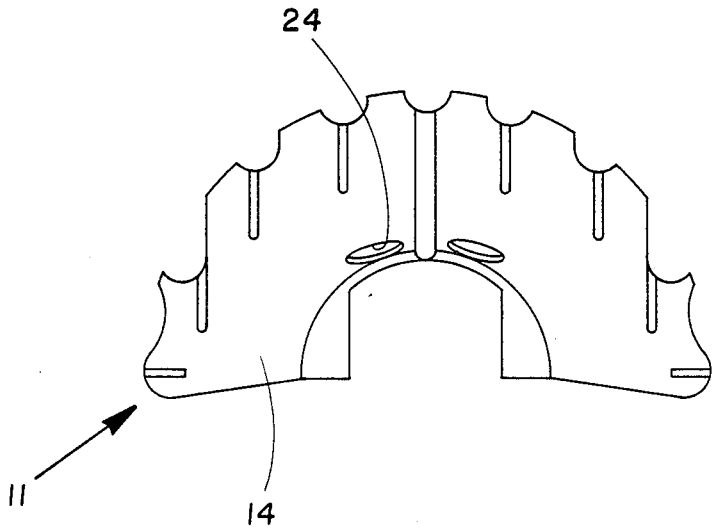
FIG. 3 is a side view of a preferred embodiment of the conduit support body employed in the present invention which is a conventional saddle-shaped packing body.

According to FIGS. 1 and 2, the conduit support body 11 (not to scale) is used to seat against the sides of adjacent electrochemical cells at a desired location, for monitoring the cell overvoltage forming a support body for conduit 28. Any number of conduit support body shapes and materials can be envisioned for use with the assembly of the present invention. The support body 11 must be substantially chemically and heat resistant to the cell bath, have sufficient mechanical strength to withstand being sandwiched between cells or electrode chamber walls without pinching the conduit 28 and be of such configuration as to seat against the side walls of the cells. Although other shapes for support body 11 can be used, it has been found that a saddle-shaped body provides good seating and sufficient strength. FIGS. 3 and 4 show in more detail a preferred support body 11 as a saddle-shaped conduit support body 11. The material from which support body 11 is produced is preferably a material which is substantially resistant to the electrochemical cell environment, and more preferably, is a plastic material. A more preferred plastic material is a thermoplastic material, such as poly(vinylidene halide), usually in which the halide is selected from chloride or fluoride, and most preferably is poly(vinylidene fluoride), although other materials are also suitable. A preferred embodiment of conduit support body 11 is shown in FIGS. 1, 2, 3 and 4, and is a saddle-shaped body having upper surface 26 facing upward and is seated lengthwise against electrode wall 16 of the selected electrochemical cell 18 to be monitored and against the wall 20 of the adjacent electrochemical cell in multicell electrolyzer 22. It should be noted that FIGS. 1 and 2 are exaggerated regarding the space between the cells, the location of the conduit support body, and generalized for the purpose of clearly representing the orientation of said conduit support body 11. A preferred form of conduit support body 11 is a saddle-shaped body of the type generally used as packing materials, e.g., in a distillation column. A most preferred conduit support body 11 is an Intalox saddle of the type produced by Norton Chemical Process Products Division, Norton Company. No claim is made to the body per se which is known.

Located in conduit support body 11 is at least one aperture 24 which extends from upper surface 26 completely through the lower surface 14 of support body 11, as shown in more detail in FIGS. 3 and 4. Aperture 24 permits passage of, and holds in frictional engagement, conduit 28. Conduit 28 is preferably a multilayered tube which is resistant to chemical attack from the cell bath and the chlorine or caustic solution generated in the multicell electrolyzer 22. More preferably, the outer layer is a thermoplastic polymer, and most preferably the conduit 28 outer layer is a polyolefin selected from polyethylene and polypropylene. The inner layer of conduit 28 is preferably a polytetrafluoroethylene. The conduit support body 11 holds conduit 28 away from the walls 16 and 20 and, thus, prevents the conduit from being crimped, pinched or kinked when the electrochemical cells of the multicell electrolyzer 22 are pressed together during operation and prevents dislocation of the end of conduit 28 from adjacent the selected electrochemical cell which is to be monitored. As the cells of the electrolyzer are being set for operation, one end of conduit 28 is placed through conduit support body 11 and adjacent to an electrode wall 16, either anode or cathode of the cell. However, the end of conduit 28 does not touch the electrode wall 16, or if it does touch is not completely seated and sealed to electrode wall 16, allowing cell bath easy entry into conduit 28. The other end of conduit 28 is attached to a standard calomel reference electrode 32 (see FIG. 1).

As shown pictorially in FIG. 1, the conduit 28 after passing through the conduit support body 11, continues past the end of the electrochemical cell and into the gas dome or cap 34 and exits through a gas vent hole 37 and through its riser pipe 36 which is attached to the vent hole 34 during operation of the cells. If the conduit 28 is in an anode compartment, it would exit through the chlorine gas vent. Likewise, if conduit 28 is in a cathode compartment, it would exit through the hydrogen vent system. As again shown in FIG. 1, the conduit 28 exits the riser pipe 36, or other gas vent system, through a hole in stopper 38 and continues until a convenient place to attach conduit 28 to standard calomel reference electrode 32, either directly or in a conveniently dimensioned cell bath reservoir (not shown in detail). The reference electrode 32 is electrically connected via conduit line 40 to one terminal of voltmeter 42 and from the other terminal of voltmeter 42 a second conductor line 44 connects the electrode wall 16, either anode or cathode, such as electrode wall 16, depending on whether it is desired to measure the anode or cathode overvoltage, and thus completes an electrical circuit.

Although shown in expanded set up in FIGS. 1 and 2, the multicell electrolyzer 22, in operation, has cell 35 and the selected electrochemical cell 18 pressed together with other adjacent cells (not shown) in gas tight fitment and fitted with appropriate lines and electrical connections for operation, as is well known in the electrochemical industry and as is described in the background reference.

In operation, the method for monitoring the selected electrochemical cell includes the steps of connecting the apparatus set up as indicated hereinabove, operating the multicell electrolyzer, and reading the voltage given on the voltmeter for comparison to a standard voltage.

When a multicell electrolyzer for the production of caustic solution and chlorine from brine is operated under nominal conditions the cell voltage will be from 2–5 volts. Each particular cell of the multicell electrolyzer will have a voltage dependent on the cathode and anode materials, the current density, and separator material. A higher than normal voltage probably indicates improper connection to the cell, for example, to the electrode of an adjacent cell. Further, bubbles of gas in the cell bath located in the conduit 28 from the cell to the standard reference electrode will also cause anomalous readings and should be removed from the conduit.

In an apparatus set up as described in FIGS. 1 and 2, a multicell electrolyzer apparatus ran for a period of almost six months with no breakage, pluggage or leaks in the monitor system and gave readings indicating that the selected electrochemical cell of the multicell electrolyzer was operating within the desired range.

Having described the invention, one skilled in the art will recognize that various modifications, changes and variations are possible within the scope and spirit of the invention. It therefore desired that the present invention only be limited by the lawful scope of the following claims.

We claim:

1. A continuous monitor reference electrode assembly for a caustic-chlorine electrolyzer having one or more electrochemical cells, each cell having electrode chamber walls, electrode screens, and including a selected electrochemical cell or a site thereon to be monitored, which assembly comprises (a) a voltmeter, (b) a standard calomel reference electrode connected to said voltmeter and in contact with the cell bath of a selected electrochemical cell which is to be monitored by said reference electrode and which cell is also connected to said voltmeter through a cell electrode;

(c) a continuous hollow flexible conduit having one end passing through said aperture of said conduit support body and being proximate said body and open to an electrode of said selected electrochemical cell, but spaced apart therefrom and the other end associated with said reference electrode and providing fluid contact for said cell bath with said reference electrode;

(d) a conduit support body which is free from structural integration with said electrolyzer and non-attachable to the electrode screen and having an aperture therein, said body is seated between said walls adjacent said selected electrochemical cell and located at a predetermined site thereon so that said conduit is supported at a predetermined location between said walls of said electrolyzer and adjacent said selected electrochemical cell, wherein said body is seated between said walls and prevents said conduit from being pinched or dislocated during the pressing together of said walls of said electrolyzer during set up operation prior to start up and operation thereof;

whereby said cell bath from said selected electrochemical cell flows to said reference electrode and performance of said selected electrochemical cell can be determined from said voltmeter.

2. The assembly of claim 1 in which said body is composed of a thermoplastic polymer material.

3. The assembly of claim 2 in which said thermoplastic material is a poly(vinylidene) halide.

4. The assembly of claim 3 in which said halide is selected from chloride and fluoride.

5. The assembly of claim 3 in which said halide is fluoride.

6. The assembly of claim 1 in which said conduit is a multilayered conduit, having at least an inner layer and an outer layer.

7. The assembly of claim 6 in which said outer layer of said conduit comprises a thermoplastic polymer material.

8. The assembly of claim 6 in which said inner layer of said conduit comprises a poly(tetrafluoroethylene) material.

9. The assembly of claim 7 in which said thermoplastic material is a polyolefin.

10. The assembly of claim 9 in which said polyolefin is selected from polyethylene and polypropylene.

11. The assembly of claim 10 in which said polyolefin is polypropylene.

12. The assembly of claim 6 in which said multilayered line comprises a double layer in which the inner layer is a poly(tetrafluoroethylene) and the outer layer is a polyolefin.

13. The assembly of claim 12 in which said body comprises a poly(vinylidene halide).

* * * * *